US008342912B2

(12) United States Patent
Funatsu et al.

(10) Patent No.: US 8,342,912 B2
(45) Date of Patent: Jan. 1, 2013

(54) ABRASIVE WATER JET PROCESSING MACHINE

(75) Inventors: Akihiro Funatsu, Uozu (JP); Takuya Aoki, Nyuzen-machi (JP)

(73) Assignee: Sugino Machine Limited, Uozu-shi, Toyama (JP)

( * ) Notice: Subject to any disclaimer, the term of this patent is extended or adjusted under 35 U.S.C. 154(b) by 0 days.

(21) Appl. No.: 13/458,626

(22) Filed: Apr. 27, 2012

(65) Prior Publication Data

US 2012/0214386 A1 Aug. 23, 2012

Related U.S. Application Data

(63) Continuation of application No. 13/370,103, filed on Feb. 9, 2012.

(30) Foreign Application Priority Data

Feb. 2, 2011 (JP) ..... 2011-020518

(51) Int. Cl.
*B24C 9/00* (2006.01)

(52) U.S. Cl. ..... 451/89; 451/2; 451/99; 451/100; 451/101

(58) Field of Classification Search ..... 451/2, 99, 451/100, 101; 83/53, 177
See application file for complete search history.

(56) References Cited

U.S. PATENT DOCUMENTS 3,543,444 A * 12/1970 Mehta ..... 451/2
4,209,952 A * 7/1980 Odds ..... 451/2
4,934,111 A * 6/1990 Hashish et al. ..... 451/102
5,107,630 A * 4/1992 Lodewijk ..... 451/88
5,339,715 A * 8/1994 Coleman ..... 83/53
5,800,246 A * 9/1998 Tomioka ..... 451/2
6,200,203 B1 * 3/2001 Xu et al. ..... 451/99
2007/0218808 A1 * 9/2007 Shimizu et al. ..... 451/5
2012/0021676 A1 1/2012 Schubert

FOREIGN PATENT DOCUMENTS

JP 7-1338 1/1995
JP 2002-233957 8/2002
JP 2008-194773 8/2008

* cited by examiner

*Primary Examiner* — George Nguyen
(74) *Attorney, Agent, or Firm* — Merchant & Gould P.C.

(57) ABSTRACT

An abrasive water jet processing machine for jetting a fluid and performing a cutting includes a fluid supply device, an abrasive supply device, an injection pressure controller, wherein the abrasive supply device includes a reservoir hopper consisting of a pressure vessel for reserving the abrasive, an abrasive supply tube for communicating with the reservoir hopper and the nozzle, and an air purge device for supplying compressed air to the abrasive supply tube and the reservoir hopper; the injection pressure controller performs a two-stage control of controlling injection pressure in a piercing; and the air purge device includes a flow pressure controller for controlling flow pressure of compressed air passing through the abrasive supply tube, wherein the flow pressure controller controls the flow pressure in the piercing to be higher than that in the cutting.

12 Claims, 3 Drawing Sheets

ABRASIVE WATER JET PROCESSING MACHINE

This application is a Continuation of U.S. application Ser. No. 13/370,103, filed 9 Feb. 2012 and which application is incorporated herein by reference. To the extent appropriate, a claim of priority is made to the above disclosed application.

BACKGROUND OF THE INVENTION

1. Field of the Invention

The present invention relates to an abrasive water jet processing machine, and particularly, to the machine for controlling flow pressure by which an abrasive is fed.

2. Description of the Related Art

Conventionally, an abrasive water jet processing machine uses negative pressure generated by high-speed water jet passing through an orifice, or a potential energy by a gravity of an abrasive, feeds the abrasive, mixes it in the water jet, ejects the jet from a nozzle, and cuts a workpiece (for example, Japanese Patent Laid-Open Publication Nos. JP H 7-1338 and JP 2008-194773).

Furthermore, with respect to an abrasive water jet processing, in stopping water jet, when water flows back to an abrasive supply tube from a nozzle, or the tube is clogged, a processing quality is degraded; therefore, as means for detecting these, there exists a method of measuring pressure in the tube and determining the backflow and the like in the tube (for example, Japanese Patent Laid-Open Publication No. JP 2002-233957 (FIG. 1)).

However, with respect to the method of using negative pressure generated by an orifice, or a potential energy by a gravity of an abrasive, and feeding the abrasive, since it is not possible to stably supply a sufficient amount of the abrasive from just after the start of water jet ejecting, and a required amount of the abrasive is not sufficiently mixed in the water jet, there exists a problem that a quality is degraded.

Particularly, with respect to a brittle material, CFRP (Carbon Fiber Reinforced Plastic), and the like, this causes in some cases a harmful effect such as a delamination in a piercing (penetration hole) which is a preceding process-of a cutting.

Furthermore, because pressure in the abrasive supply tube largely fluctuates according to water injection pressure and a supply amount of the abrasive, and it is not possible to accurately determine the backflow and the like, there exists a problem that a processing quality is degraded.

Consequently, there is a need for an abrasive water jet processing machine that prevents the backflow of a fluid and stably supplies an abrasive, thereby sets proper processing conditions, respectively, in a piercing, which is a preceding process of a cutting, and the cutting, and can achieve an abrasive water jet processing high in quality.

SUMMARY OF THE INVENTION

A first aspect of the present invention is to provide an abrasive water jet processing machine, and the machine comprises a fluid supply device configured to supply the fluid to the nozzle, an abrasive supply device configured to supply the abrasive to the nozzle and to mix the abrasive in the fluid, an injection pressure controller configured to control injection pressure for jetting the fluid, wherein the abrasive supply device comprises a reservoir hopper essentially consisting of a pressure vessel for reserving the abrasive, an abrasive supply tube configured to communicate the reservoir hopper with the nozzle, and an air purge device configured to supply compressed air to the abrasive supply tube and the reservoir hopper, to use an air flow rate increased by loading flow pressure on the abrasive passing through the abrasive supply tube by means of the compressed air, and to feed by the pressure the abrasive to the nozzle; the injection pressure controller performs a two-stage control of controlling the injection pressure in a piercing, which is a preceding process-of the cutting, to be lower than that in the cutting; and the air purge device comprises a flow pressure controller configured to control the flow pressure of the compressed air passing through the abrasive supply tube in a state of the injection pressure being controlled to be low by the injection pressure controller, wherein the flow pressure controller controls the flow pressure in the piercing to be higher than that in the cutting.

The abrasive water jet processing machine according to the first aspect of the invention comprises the air purge device configured to load the flow pressure on the abrasive passing through the abrasive supply tube, and thereby, can use an increased air flow rate and stably supply the abrasive to the nozzle; therefore, the machine can stably feed the abrasive without excessively depending on any of negative pressure generated by the fluid passing through an orifice and a potential energy by a gravity of the abrasive. Moreover, the abrasive water jet processing machine can effectively prevent the backflow to the abrasive supply tube from a nozzle side by increasing pressure in the abrasive supply tube.

Furthermore, the abrasive water jet processing machine according to the first aspect of the invention can effectively prevent any of a crack and fracture of a workpiece due to the abrasive not being sufficiently supplied in an initial stage of jetting by controlling the injection pressure in the piercing to be lower than that in the cutting by the injection pressure controller.

On one hand, in a state of the injection pressure being controlled to be low by the injection pressure controller, the abrasive water jet processing machine according to the first aspect of the invention comprises the flow pressure controller configured to control the flow pressure of the compressed air passing through the abrasive supply tube higher than flow pressure in the cutting, and thereby, does not excessively depend on any of negative pressure generated by the fluid passing through the orifice and the potential energy by the gravity of the abrasive; therefore, the machine can stably supply a proper amount of the abrasive without depending on a route and length of the abrasive supply tube, a positional relationship between the nozzle and the reservoir hopper, and the like.

Therefore, even when the injection pressure is set to be low in the piercing, the abrasive water jet processing machine can stably achieve the piercing of a high quality by stably supplying a sufficient amount of the abrasive.

Thus, the abrasive water jet processing machine prevents the backflow of the fluid and stably supplies the abrasive; thereby, the machine sets proper processing conditions, respectively, in the piercing, which is the preceding process of the cutting, and the cutting after the piercing, and can achieve an abrasive water jet processing high in quality.

A second aspect of the invention is to provide the abrasive water jet processing machine according to the first aspect, and the machine further comprises an abrasive tank essentially consisting of a pressure vessel for refilling the abrasive reserved in the reservoir hopper, an abrasive refill hose configured to communicate the abrasive tank with the reservoir hopper, and an air supply device configured to supply the compressed air into the abrasive tank and to load the flow pressure by the compressed air on the abrasive passing through the abrasive refill hose.

According to the second aspect of the invention, the abrasive water jet processing machine comprises the air supply device configured to load the flow pressure on the abrasive passing through the abrasive refill hose, and thereby, can stably refill the abrasive in the reservoir hopper.

A third aspect of the invention is to provide the abrasive water jet processing machine according to the first or second aspect, and the air purge device further comprises a first air flow passage configured to communicate with the reservoir hopper from an air source, a second air flow passage branched from the first air flow passage and configured to communicate with the abrasive supply tube, and a flow rate meter configured to measure a flow rate of the compressed air passing through the second air flow passage.

According to the third aspect of the invention, the abrasive water jet processing machine comprises the flow rate meter, and thereby, can control the flow rate of the compressed air supplied to the abrasive supply tube; therefore, the machine can properly control the flow rate of the abrasive fed by the flow pressure and passing through the abrasive supply tube.

A fourth aspect of the invention is to provide the abrasive water jet processing machine according to the third aspect, and the machine further comprises a backflow detector configured to detect a clogging of the abrasive in any of the abrasive supply tube and the nozzle, or a backflow of the fluid therein, by measuring the flow rate of the compressed air lower than that in the piercing by the flow rate meter.

According to the fourth aspect of the invention, because the abrasive water jet processing machine measures the flow rate of the compressed air in the second air flow passage and thereby detects the backflow in the abrasive supply tube and the nozzle, the machine can stably detect the backflow in the abrasive supply tube more accurately than detect the backflow by measuring pressure of the abrasive supply tube whose pressure largely fluctuates and is unstable.

Furthermore, the abrasive water jet processing machine can surely detect the backflow, and the clogging of the abrasive by making the flow rate of the compressed air, which is lower than the flow rate in the piercing, a threshold.

A fifth aspect of the invention is to provide the abrasive water jet processing machine according to any one of the first to fourth aspects, and the machine jets the fluid from the nozzle into a liquid of a processing bath and performs the piercing and the cutting.

According to the fifth aspect of the invention, even when the abrasive water jet processing machine performs the abrasive water jet processing in the liquid of the processing bath, the machine comprises the flow pressure controller configured to control the flow pressure of the compressed air passing through the abrasive supply tube; thereby, because the machine can properly increase the pressure in the abrasive supply tube, the machine can effectively prevent the backflow to the abrasive supply tube from the nozzle side.

Because the abrasive water jet processing machine according to the invention can prevent the backflow of any of the fluid and the abrasive and stably supply the abrasive, the machine can set the proper processing conditions, respectively, in the piercing, and the cutting, and achieve the abrasive water jet processing high in quality.

BEST MODE(S) FOR CARRYING OUT THE INVENTION

Here will be in detail described an abrasive water jet processing machine 1 according to an embodiment of the present invention with reference to the drawings as needed.

Figure 1:
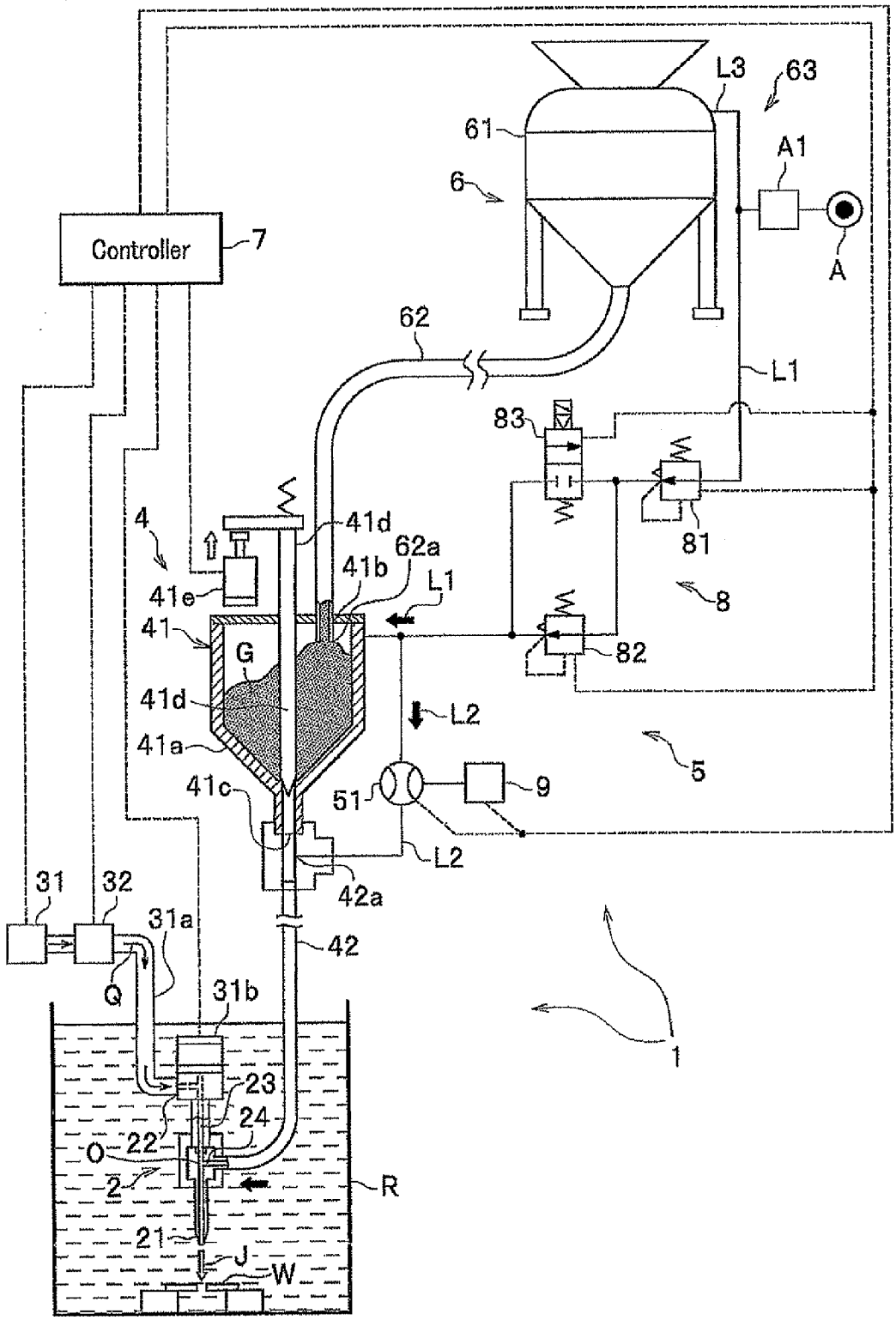
FIG. 1 is a schematic diagram showing a configuration of an abrasive water jet processing machine according to an embodiment of the present invention.

The abrasive water jet processing machine 1 is a processing apparatus, as shown in FIG. 1, for mixing an abrasive G in a fluid Q, jetting an abrasive water jet J from a nozzle 21 attached to a nozzle unit 2, and cutting a workpiece W clamped in water of a processing bath R.

The abrasive water jet processing machine 1 has a function of performing a piercing, which is a preceding process of a cutting, for forming a penetration hole, and a function of performing the cutting of various and even complicated shapes and the like with moving the abrasive water jet J that penetrates the workpiece W by the piercing; and the machine 1 can perform a universal various-shape processing such as a honeycomb shape and a gear shape with respect to diverse materials such as stainless steel, Monomer Casting nylon, CFRP, a titanium alloy, and the like.

Furthermore, because the abrasive water jet processing machine 1 can perform the piercing and the cutting in water, the machine 1 can minimize work environmental load such as noises and dust.

The abrasive water jet processing machine 1 comprises a fluid supply device 31 configured to supply the fluid Q to the nozzle 21, an abrasive supply device 4 configured to supply the abrasive G to the nozzle 21 and to mix it in the fluid Q, an injection pressure controller 32 configured to control injection pressure of the fluid Q, a backflow detector 9 configured to detect a backflow in an abrasive supply tube 42, and a controller 7.

Although water is used as the fluid Q from an easiness of handling thereof, a viscosity improver can also be added for improving a convergence property of the abrasive water jet J ejected from the nozzle 21.

The abrasive G is selected according to a kind and use of the workpiece W as needed, and a garnet abrasive, alumina and the like can also be used.

Figure 2:
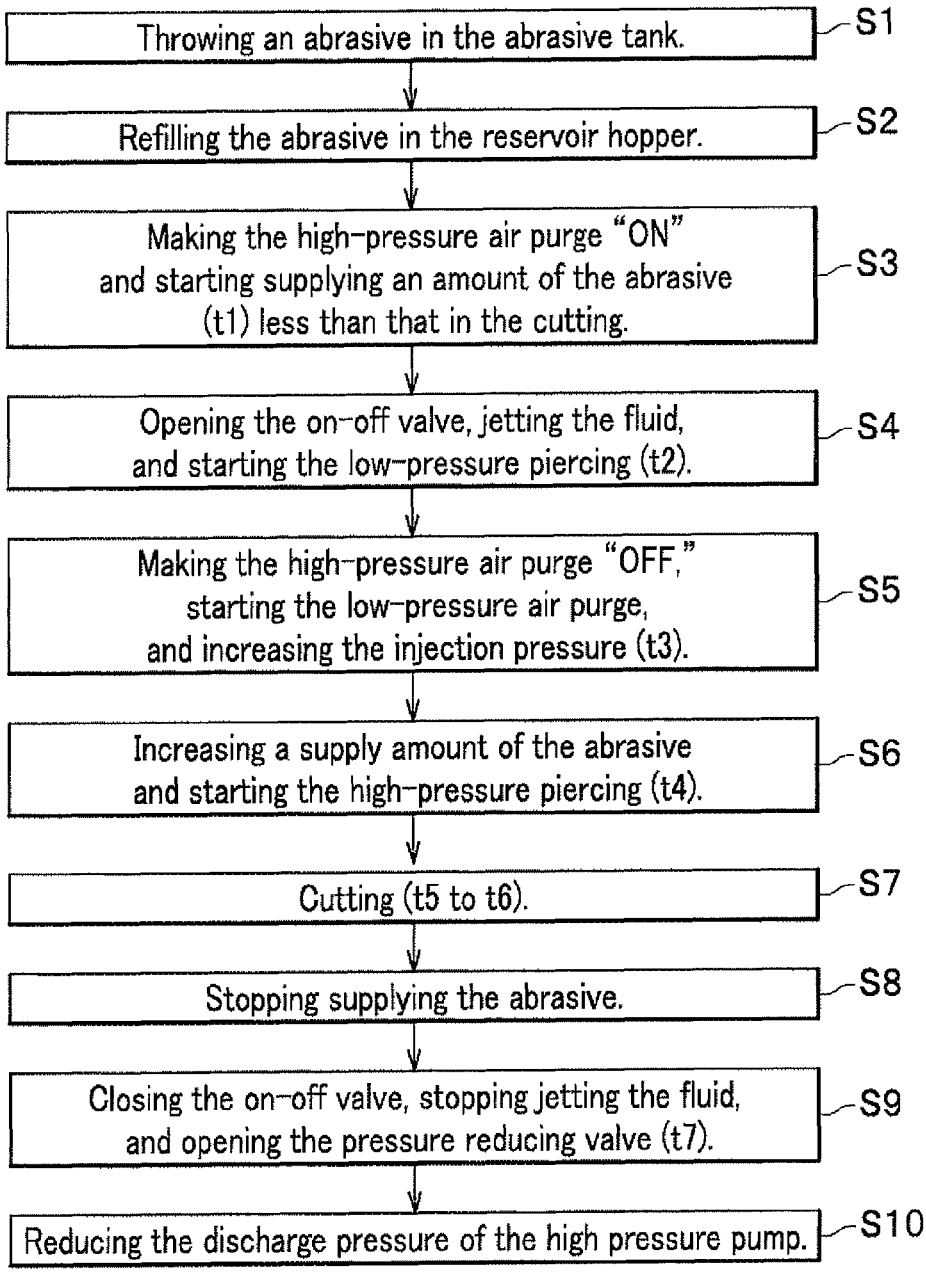
FIG. 2 is a flowchart showing operations of the abrasive water jet processing machine according to the embodiment

The fluid supply device 31 is a device configured to supply the fluid Q (ultra-high pressure water jet) pressurized to 30-400 MPa to the nozzle unit 2, and comprises a high pressure tube 31*a* communicating with the unit 2, an on-off valve 31*b* configured to regulate the ultra-high pressure water jet supplied to the unit 2, and a high pressure pump not shown (see S10 in FIG. 2).

The injection pressure controller 32 is a device configured to adjust pressure of the ultra-high pressure fluid Q supplied to the nozzle unit 2 and to control the injection pressure of the abrasive water jet J ejected from the nozzle 21; the controller 32 comprises a pressure reducing valve not shown (see items of "Pressure Reducing Valve" in FIG. 3) and is adapted to be able to appropriately adjust the injection pressure according to any of the abrasive and use of the workpiece W.

Figure 3:
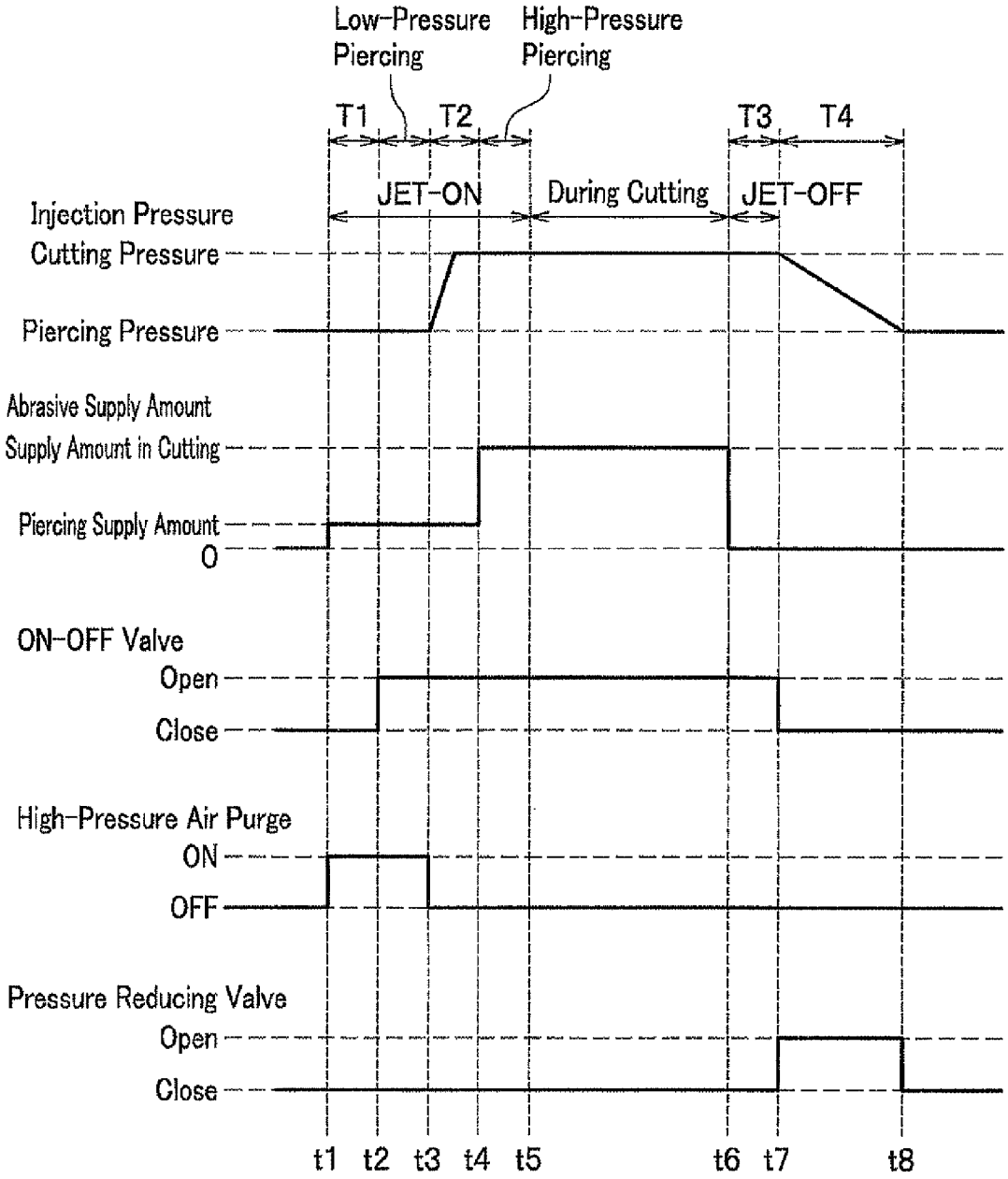
FIG. 3 is a time chart showing operations of the abrasive water jet processing machine according to the embodiment

Furthermore, the injection pressure controller 32 has a function of performing a two-stage control for controlling the injection pressure in a piercing, which is a preceding process of the cutting, to be lower than the injection pressure in the cutting (see "Injection pressure" in FIG. 3).

The nozzle unit 2 comprises an ultra-high water introduction port 22 where the fluid Q is introduced from the high pressure tube 31*a*, a ultra-high pressure water passage 23 configured to be communicated from the port 22 to the nozzle 21, and an abrasive introduction port 24 configured to communicate with the passage 23 and where the abrasive G is introduced.

According to the configuration thus described, the fluid Q is supplied by the fluid supply device 31 from the ultra-high water introduction port 22 to the nozzle 21 through the ultra-high pressure water passage 23; a proper amount of the abrasive G is introduced from the abrasive introduction port 24 by the abrasive supply device 4 and an air purge device 5; and the abrasive G is mixed in the fluid Q. Then, the fluid Q where the abrasive G is mixed is adapted to be ejected as the abrasive water jet J from the nozzle 21.

The abrasive supply device 4 comprises a reservoir hopper 41 essentially consisting of a pressure vessel for reserving the abrasive G, the abrasive supply tube 42 configured to communicate the hopper 41 with the nozzle unit 2, the air purge device 5 configured to load flow pressure on the abrasive G passing through the tube 42, and an abrasive refill device 6 for refilling the abrasive G in the hopper 41.

The reservoir hopper 41 is a device for measuring a proper amount of the abrasive G mixed in the fluid Q supplied to the nozzle 21 and supplying the abrasive G to the nozzle 21.

The reservoir hopper 41 comprises a pressure vessel 41*a* for reserving a constant amount of the abrasive G, an introduction port 41*b* for refilling the abrasive G from the abrasive refill device 6, a discharge port 41*c* for discharging the abrasive G, a needle valve 41*d* for adjusting a bore of the port 41*c*, and an actuator 41*e* for driving the valve 41*d*. The actuator 41*e* uses, for example, a direct drive actuator having an encoder and is controlled by the controller 7.

According to the configuration thus described, when the needle valve 41*d* is moved in an opening direction (upward direction in FIG. 1) by the actuator 41*e* of the reservoir hopper 41, a supply amount of the abrasive G is increased; when the needle valve 41*d* is moved in a closing direction (downward direction in FIG. 1) by the actuator 41*e*, the supply amount of the abrasive G is decreased.

Thus, the abrasive supply device 4 controls an operation of the needle valve 41*d* by the actuator 41*e* and adjusts the bore of the discharge port 41*c;* thereby, it is possible to discharge from the port 41*c* a proper amount of the abrasive G mixed in the abrasive water jet J. Then, the abrasive G discharged from the discharge port 41*c* is fed by the flow pressure from the air purge device 5 to the nozzle unit 2 through the abrasive supply tube 42.

The abrasive supply tube 42 is a tube of a supply passage of the abrasive G, wherein the tube 42 connects the discharge port 41*c* of the reservoir hopper 41 and the abrasive introduction port 24, and comprises a compressed air introduction port 42*a* where compressed air is introduced from the air purge device 5.

The air purge device 5 is a device configured to supply the compressed air to the abrasive supply tube 42 and the reservoir hopper 41, to use an air flow rate increased by loading the flow pressure on the abrasive G passing through the tube 42 by the compressed air, and to feed by the pressure the abrasive G reserved in the hopper 41 to the nozzle unit 2.

The air purge device 5 comprises a first air flow passage L1 communicating with the reservoir hopper 41 from an air source A, a second air flow passage L2 branched from the passage L1 and communicating with the abrasive supply tube 42, a flow rate meter 51 for measuring a flow rate of the compressed air passing through the passage L2, and a pressure controller 8 for controlling the flow pressure of the compressed air passing through the tube 42.

The first air flow passage L1 is a flow passage for supplying compressed air controlled to predetermined pressure through an air controller A1 from the air source A to the reservoir hopper 41 through the pressure controller 8, wherein the controller A1 consists of an air compressor and the like.

The second air flow passage L2 is a flow passage branched from between the first air flow passage L1 and the reservoir hopper 41 and is communicated to the abrasive supply tube 42, and the flow rate meter 51 is arranged on the way of the second air flow passage L2. The compressed air supplied to the abrasive supply tube 42 is monitored by the flow rate meter 51.

According to the configuration thus described, the air purge device 5 supplies the compressed air supplied from the air source A to the reservoir hopper 41 through the first air flow passage L1, supplies the compressed air to the abrasive supply tube 42 through the second air flow passage L2 branched from the first air flow passage L1, and thereby, can stably control a supply amount of the abrasive G when the needle valve 41*d* is opened.

That is, when the compressed air is supplied from the air purge device 5 to the abrasive supply tube 42, if the compressed air is supplied only to the second air flow passage L2, pressure in the tube 42 becomes higher than that in the reservoir hopper 41, and thereby, the supply of the abrasive G is hindered; whereas, by supplying the compressed air to the first air flow passage L1, because the pressure of the hopper 41 and the tube 42 is equal, the device 5 can stably supply the abrasive G.

Furthermore, because the air purge device 5 monitors the compressed air supplied to the abrasive supply tube 42 by the flow rate meter 51, the device 5 can favorably set the flow pressure of the compressed air passing through the tube 42.

Accordingly, when the abrasive G reserved in the reservoir hopper 41 are discharged to the abrasive supply tube 42, properly controlled pressure can be loaded on the abrasive G passing through the tube 42; therefore, the air purge device 5 can favorably feed by the flow pressure a proper amount of the abrasive G from the hopper 41 to the nozzle unit 2.

The pressure controller 8 has a function of controlling the flow pressure in the piercing to be higher than that in the cutting and comprises a high-pressure air purge regulator 81, a low-pressure air purge regulator 82, and a change-over valve 83 for changing high-pressure air purge and low-pressure air purge.

In addition, although the pressure controller 8 is a device for controlling the flow pressure of the compressed air passing through the abrasive supply tube 42 and supplying a proper amount of the abrasive G to the nozzle 21, the pressure and flow rate of the compressed air correlate, and a supply amount of the abrasive G depends on the flow rate of the compressed air; therefore, the controller 8 may also adjust the flow rate of the compressed air and thereby adjust the pressure.

Here, the low-pressure air purge is pressure (flow pressure) higher than that (0.01 MPa) at a top end 62*a* of an abrasive refill hose 62 described later, is in the embodiment assumed to be equal to that in the cutting (see FIG. 3), and is appropriately set within a range of, for example, 0.01 to 0.1 MPa, considering a material of the workpiece W and such a supply amount of the abrasive G in the cutting.

The high-pressure air purge is pressure (flow pressure) higher than that of the low-pressure air purge and is appropriately set within a range of, for example, 0.050 to 0.2 MPa, considering the injection pressure in the piercing and a supply amount of the abrasive G.

According to the configuration thus described, when the change-over valve 83 is changed by the controller 7, and the first air flow passage L1 is communicated from the air source A to the reservoir hopper 41, the high-pressure compressed air is supplied to the abrasive supply tube 42 from the second air flow passage L2 and thus the high-pressure air purge is performed; when the change-over valve 83 is shut off, the low-pressure air purge is performed.

The abrasive refill device 6 is a device for refilling the abrasive G in the hopper 41 and comprises an abrasive tank 61 essentially consisting of a pressure vessel where the abrasive G is reserved, the abrasive refill hose 62 for communicating with the tank 61 and the reservoir hopper 41, and an air supply device 63 for supplying the compressed air into the tank 61 and loading the flow pressure by the compressed air on the abrasive G passing through the hose 62.

Because the air supply device 63 supplies the compressed air of 0.4 MPa to the abrasive tank 61 from an air flow passage L3 through the air controller A1 from the air source A, the abrasive G is supplied from the tank 61 to the reservoir hopper 41.

Here, supplying the compressed air of 0.4 MPa to the abrasive tank 61 from the air flow passage L3 is directed to set inner pressure loaded on the tank 61 so as to be reduced and become at the end 62*a* slightly higher than atmospheric pressure before the inner pressure reaches the top end 62*a* of the abrasive refill hose 62. For example, the inner pressure at the top end 62*a* is assumed to be 0.01 MPa when the pressure is displayed by making the atmospheric pressure a reference.

The top end 62*a* of the abrasive refill hose 62 is held to be positioned at a predetermined height in the reservoir hopper 41, and the abrasive G is adapted to be always reserved as far as a level of a constant amount in the hopper 41.

That is, because the inner pressure is loaded on the abrasive tank 61, when the abrasive G does not reach the top end 62*a* of the abrasive refill hose 62, the abrasive G is stably refilled in the reservoir hopper 41 from the tank 61.

On one hand, when an amount of the abrasive G reserved in the reservoir hopper 41 increases, and the abrasive G reaches the top end 62*a* of the abrasive refill hose 62, the abrasive G occludes the end 62*a;* therefore, it is adapted that the air supply device 63 cannot supply the abrasive G, opposing the atmospheric pressure, and stops supplying the abrasive G.

When the backflow detector 9 measures by the flow rate meter 51 a flow rate of the compressed air lower than that of the compressed air in the flow pressure (low-pressure air purge) of the piercing, the detector 9 detects any of a backflow of the fluid Q mixed with the abrasive G and a clogging of the G in the abrasive supply tube 42, and in detecting the backflow and the clogging, can warn an operator by a warning light and the like, and stop the piercing.

The backflow detector 9 can stably detect the backflow by installing the flow rate meter 51 on the way of the second air flow passage L2. That is, pressure in the reservoir hopper 41 changes according to an abrasive supply condition from the abrasive refill device 6, and a flow rate flowing in the first air flow passage L1 is also influenced by the inner pressure of the reservoir hopper 41. On one hand, a flow rate flowing in the second air flow passage L2 is constant without being influenced by a change of the abrasive supply condition from the abrasive refill device 6. This is because flow rates of the second air flow passage L2 and the abrasive supply tube 42 are equal due to being decided by the injection pressure and bore of the nozzle 21. Accordingly, by measuring the flow rate of the second air flow passage L2 by the flow rate meter 51, the backflow detector 9 can stably detect the backflow.

Subsequently, operations of the abrasive water jet processing machine 1 according to the embodiment thus configured will be described mainly with reference to FIGS. 2 and 3.

Here, in FIG. 3, items of "Injection Pressure" are those of the injection pressure from the nozzle 21 (see FIG. 1) and indicate that a two-stage control of controlling injection pressure (indicated as "Piercing Pressure") in a low pressure piercing (t2≦time<t3) to be lower than injection pressure (indicated as "Cutting Pressure") in a cutting (indicated as "During Cutting," t5≦time<t6) is performed by the injection pressure controller 32.

Items of "Abrasive Supply Amount" indicate supply amounts of the abrasive G supplied from the reservoir hopper 41 to the nozzle unit 2 through the abrasive supply tube 42 (see FIG. 1), and the supply amounts are adjusted by controlling operations of the needle valve 41*d* by the abrasive supply device 4.

Items of "ON-OFF Valve" are items for controlling the on-off valve 31*b* (see FIG. 1) and thus controlling an introduction and shut-off of the fluid Q (see FIG. 1) to the nozzle unit 2: when the valve 31*b* is in a state of "Close," the fluid Q is not supplied to the unit 2 (t1≦time<t2, t7≦time); when the valve 31*b* is in a state of "Open," the fluid Q is supplied and jetted from the nozzle 21 (t2≦time<t7).

Items "ON" and "OFF" of "High-Pressure Air Purge" are items for controlling the flow pressure of the abrasive G by the pressure controller 8 (see FIG. 1): when the controller is in a state of "ON", the high-pressure air purge is performed; when the controller is in a state of "OFF", the low-pressure air purge is performed.

[Preparation Before Start of Process]

As a preparation before a start of a process in the abrasive water jet processing machine 1, as shown in FIG. 2, when the abrasive G is thrown in the abrasive tank 61 (see FIG. 1) (S1), the abrasive G is refilled in the reservoir hopper 41 (S2).

[Piercing]

As shown in FIG. 3, a period (T1) is t1≦time<t2 required for a preparation of the piercing and is a supply waiting time by which the abrasive G reaches the nozzle unit 2 from the reservoir hopper 41 (see FIG. 1); at the time t1, the supply of the abrasive G is started, and the "High-Pressure Air Purge" is made "ON" and started (see S3 in FIG. 2).

The piercing is performed, as shown in FIG. 3, t2≦time<t5 by dividing the piercing into the low-pressure piercing (see S4 in FIG. 2) and the high-pressure piercing (see S6 in FIG. 2), wherein the injection pressure in the low-pressure piercing and the high-pressure piercing is different in stages.

That is, for t2≦time<t3 is performed the low-pressure piercing where the injection pressure of the abrasive water jet J is low; for t4≦time<t5 is performed the high-pressure piercing where the injection pressure of the abrasive water jet J is high and is same as that of the cutting. A period of t3≦time<t4 is a preparation time (T2) for the high piercing.

As shown in FIG. 3, in the low-pressure piercing (t2≦time<t3) the supply amount of the abrasive G is set to be less than that in cutting as shown in the items of the "Abrasive Supply Amount"; whereas, because the high-pressure air purge is made "ON" (time t1), as shown in the items of the "High-Pressure Air Purge," the high-pressure air purge is performed.

Thus, the abrasive water jet processing machine 1 controls by the pressure controller 8 the flow pressure of the compressed air passing through the abrasive supply tube 42 to be higher than the flow pressure in the cutting (the "High-Pressure Air Purge") in a state of the injection pressure being controlled to be low by the injection pressure controller 32 (see FIG. 1), and performs the low-pressure piercing.

The abrasive water jet processing machine 1 performs the high-pressure air purge in the low-pressure piercing, and thereby, can stably supply a proper amount of the abrasive G without depending on a route and length of the abrasive supply tube 42, a positional relationship between the nozzle 21 and the reservoir hopper 41, and the like; therefore, even when the injection pressure is set to be low in the low-pressure piercing, the machine 1 can effectively prevent any of a crack and fracture of the workpiece W and stably achieve the piercing of a high quality.

After the low-pressure piercing is performed, a preparation of making transition to the high-pressure piercing is performed (see S5 in FIG. 2). That is, the period (T2) of t3≦time<t4 is a waiting time by which the injection pressure is increased until it becomes same to the cutting pressure, the "High-Pressure Air Purge" is made "OFF" (t3), the high-pressure air purge makes transition to the low-pressure air purge same in the cutting, and the preparation for making transition to the high-pressure piercing is performed by increasing the injection pressure.

In the high-pressure piercing (t4≦time<t5) the "Abrasive Supply Amount" is same as in the cutting, and the low-pressure air purge is performed similarly in the cutting (see S6 in FIG. 2). By performing the high-pressure piercing, it is possible to shorten the piercing period and to speedily make transition to the cutting.

[Cutting]

The cutting is performed for t5≦time<t6 (see S7 in FIG. 2). As shown in FIG. 3, during the cutting, the "Injection Pressure" and the "Abrasive Supply Amount" are set to be higher than those in the low-pressure piercing (see the items of the "Cutting Pressure" and "Supply Amount in Cutting"), and because the high-pressure air purge is "OFF" (see the items of the "High-Pressure Air Purge"), the low-pressure air purge is performed.

When the cutting is completed, the supply of the abrasive G is stopped by closing the needle valve 41*d* of the abrasive supply device 4 (see S8 in FIG. 2); jetting the abrasive water jet J is stopped by closing the on-off valve 31*b* (see FIG. 1); and the pressure in the nozzle unit 2 is released by opening a pressure reducing valve not shown (see S9 in FIG. 2). Then by reducing discharge pressure of a high pressure pump not shown of the fluid supply device 31, the abrasive water jet processing machine 1 is made to be in a waiting state (see S10 in FIG. 2).

The abrasive water jet processing machine 1 according to the embodiment of the present invention brings an operation and effect as follows:

That is, the flow pressure is loaded on the abrasive G passing through the abrasive supply tube 42 by the air purge device 5, and thereby, using an increased air flow rate, the abrasive G can be stably supplied to the nozzle 21; therefore, without excessively depending on any of negative pressure generated by the fluid Q passing through an orifice O and a potential energy by the gravity of the abrasive G, it is possible to stably feed the abrasive G.

Therefore, in addition to a case of jetting the abrasive water jet J downward from the nozzle 21 (see FIG. 1), even in a case of jetting it sideward or upward (not shown), it is possible to supply a proper amount of the abrasive G.

Furthermore, by stably loading the flow pressure on the abrasive G passing through the abrasive supply tube 42, it is possible to effectively prevent the backflow to the tube 42 from a nozzle unit 2 side even in a state of the unit 2 even including the on-off valve 31*b* being immersed in the water of the processing bath R.

Although the embodiment of the invention has been thus described, the invention is not limited thereto and can be appropriately changed and performed.

For example, in the embodiment, the piercing is performed in the two stages of the low-pressure piercing and the high-pressure piercing; however, the piercing may be completed by the low-pressure piercing, the high-pressure piercing may be omitted, and after a pressurization waiting time may be taken, a transition to the cutting may also be made; if the piercing may include the low-pressure piercing, it is available; and a piercing having three stages of the low pressure, middle pressure, and the high pressure, and another piercing having more than three stages may also be performed.

Furthermore, in the embodiment, although the air pressure (flow pressure) of the low-pressure air purge in the high-pressure piercing is assumed to be equal to the air pressure (flow pressure) in the cutting, the air pressure of the low-pressure air purge is not limited thereto; the air pressure of the low-pressure air purge in the high-pressure piercing may be appropriately set within a range of an air pressure lower than the air pressure of the high-pressure air purge in the low-pressure piercing and higher than the air pressure in the cutting, and make gradual transition to the flow pressure in the cutting.

What is claimed is:

1. An abrasive water jet processing machine for jetting a fluid where an abrasive is mixed from a nozzle and performing a cutting, the machine comprising:

a fluid supply device configured to supply the fluid to the nozzle;

an abrasive supply device configured to supply the abrasive to the nozzle and to mix the abrasive in the fluid; and an injection pressure controller configured to control injection pressure for jetting the fluid, the abrasive supply device comprising:

a reservoir hopper essentially consisting of a pressure vessel for reserving the abrasive;

an abrasive supply tube configured to communicate the reservoir hopper with the nozzle; and an air purge device configured to supply compressed air to the abrasive supply tube and the reservoir hopper, to use an air flow rate increased by loading flow pressure on the abrasive passing through the abrasive supply tube by means of the compressed air, and to feed by the flow pressure the abrasive to the nozzle, the injection pressure controller performing a two-stage control of controlling the injection pressure in a piercing, wherein the piercing occurs prior to the cutting and is performed at a lower pressure than the injection pressure for cutting, the air purge device comprising a flow pressure controller configured to control the flow pressure of the compressed air passing through the abrasive supply tube in a state of the injection pressure being controlled to be low by the injection pressure controller, wherein the flow pressure controller controls the flow pressure in the piercing to be higher than the flow pressure in the cutting.

2. The abrasive water jet processing machine according to claim 1, the machine further comprising:

an abrasive tank essentially consisting of a pressure vessel for refilling the abrasive reserved in the reservoir hopper;

an abrasive refill tube for communicating with the abrasive tank and the reservoir hopper; and an air supply device configured to supply the compressed air in the abrasive tank and to load the flow pressure by the compressed air on the abrasive passing through the abrasive refill hose.

3. The abrasive water jet processing machine according to claim 1, the air purge device further comprising:

a first air flow passage configured to communicate with the reservoir hopper from an air source;

a second air flow passage branched from the first air flow passage and configured to communicate with the abrasive supply tube; and a flow rate meter configured to measure a flow rate of the compressed air passing through the second air flow passage.

4. The abrasive water jet processing machine according to claim 2, the air purge device further comprising:

a first air flow passage configured to communicate with the reservoir hopper from an air source;

a second air flow passage branched from the first air flow passage and configured to communicate with the abrasive supply tube; and a flow rate meter configured to measure a flow rate of the compressed air passing through the second air flow passage.

5. The abrasive water jet processing machine according to claim 3 further comprising a backflow detector configured to detect a clogging of the abrasive in any of the abrasive supply tube and the nozzle, or a backflow of any of the fluid and the abrasive in any of the abrasive supply tube and the nozzle, by measuring the flow rate of the compressed air lower than the flow rate in the piercing.

6. The abrasive water jet processing machine according to claim 4 further comprising a backflow detector configured to detect a clogging of the abrasive in any of the abrasive supply tube and the nozzle, or a backflow of any of the fluid and the abrasive in any of the abrasive supply tube and the nozzle, by measuring the flow rate of the compressed air lower than the flow rate in the piercing.

7. The abrasive water jet processing machine according to claim 1 jetting the fluid from the nozzle into a liquid of a processing bath and performs the piercing and the cutting.

8. The abrasive water jet processing machine according to claim 2 jetting the fluid from the nozzle into a liquid of a processing bath and performs the piercing and the cutting.

9. The abrasive water jet processing machine according to claim 3 jetting the fluid from the nozzle into a liquid of a processing bath and performs the piercing and the cutting.

10. The abrasive water jet processing machine according to claim 4 jetting the fluid from the nozzle into a liquid of a processing bath and performs the piercing and the cutting.

11. The abrasive water jet processing machine according to claim 5 jetting the fluid from the nozzle into a liquid of a processing bath and performs the piercing and the cutting.

12. The abrasive water jet processing machine according to claim 6 jetting the fluid from the nozzle into a liquid of a processing bath and performs the piercing and the cutting.

* * * * *